United States Patent [19]

Huston, Jr.

[11] Patent Number: 4,566,365

[45] Date of Patent: Jan. 28, 1986

[54] CHORD PLAYING ATTACHMENT FOR STRINGED MUSICAL INSTRUMENTS

[76] Inventor: Roy E. Huston, Jr., 2 Alkaid St. NW., Rome, Ga. 30161

[21] Appl. No.: 658,358

[22] Filed: Oct. 5, 1984

[51] Int. Cl.[4] ..... G10D 3/00

[52] U.S. Cl. ..... 84/317

[58] Field of Search ..... 84/315–318

[56] References Cited

U.S. PATENT DOCUMENTS

| | | | |
|---|---|---|---|
| 745,557 | 12/1903 | Baker | 84/315 |
| 2,221,143 | 11/1940 | Lang | 84/483 A |
| 2,450,210 | 9/1948 | Sprague | 84/315 |
| 3,915,051 | 10/1975 | Kincaid | 84/317 |
| 4,406,207 | 9/1983 | Criscione | 84/411 P |
| 4,475,433 | 10/1984 | Williamson et al. | 84/318 |

*Primary Examiner*—Lawrence R. Franklin
*Attorney, Agent, or Firm*—Paul L. Hickman

[57] ABSTRACT

A device for playing chords on a musical instrument by depressing a single pushbutton, the device being characterized by an L shaped base having a shorter leg which engages a side of the neck of the musical instrument and a longer leg which overlies the strings of the instrument. A number of spacers are provided to maintain separation inbetween the base and the strings, and a pair of straps encircle the neck to hold the base in position. Three pushbutton assemblies are provided, each of which depresses three strings on a musical instrument. The pushbuttons are color coded to correspond to colored indicia provided on the sheet music.

1 Claim, 8 Drawing Figures

CHORD PLAYING ATTACHMENT FOR STRINGED MUSICAL INSTRUMENTS

BACKGROUND OF THE INVENTION

1. Field of the Invention

This invention relates generally to musical instruments, and more particularly to devices which aid in playing musical instruments.

2. Description of the Prior Art

Stringed instruments typically have a hollow, resonant body; a long, narrow neck extending from the body; and a row of strings stretched between a bridge provided on the base of the body to a bridge provided near the end of the neck. Some stringed instruments are fretted, such as guitars and banjos, and other stringed instruments, such as the violin, are not.

Different chords are produced on a stringed instrument by pressing various strings against the neck of the instrument with the fingers of one hand and strumming or plucking the strings with the other hand. One of the greatest difficulties in learning to play a stringed instrument is memorizing the correct fingers positions for various musical chords.

This problem has been addressed in the prior art by the development of a number of chord playaing attachments for stringed instruments. Examples of such chord playing attachments can be found in U.S. Pat. Nos. 4,030,400; 3,915,051; 2,669,151; 2,517,000; 3,446,108; 3,776,008; 3,422,717; 2,450,210; and 4,331,059.

Typically, the chord playing attachments of the prior art include a support member, means for attaching the support member to the neck of the instrument, and a number of pushbuttons coupled to the support member and adapted to press one or more strings against the neck of the instrument. A problem with the chord playing attachments of the prior art is that they tend to be more complex than that required for a person just beginning to learn how to play the instrument.

For example, in U.S. Pat. No. 4,030,400 of Castillo, a plurality of hermetically closed systems are used to press the strings against the neck of the instrument, each system including a pair of pneumatically operated bellows. Other devices, such as the one disclosed in U.S. Pat. No. 2,517,000 of LaRose use a number of pivots, levers, and actuators to accomplish the same result. The mechanisms of Castillo and Rose are very sophisticated to allow many different chords to be played. This very sophistication, however, increases the complexity and cost of the attachment.

Another problem with chord playing attachments of the prior art is with their attachment mechanism which couple them to the neck of the guitar. Some attachment mechanisms, such as the one disclosed in U.S. Pat. No. 3,446,108 of Mitchell are extraordinarily complex, including a number of adjustments, thumb screws, etc. On the other hand, other chord playing attachments, such as that taught in U.S. Pat. No. 3,776,088 of Jones are so simple that the user may find it difficult to align the device properly with the strings of the instrument.

SUMMARY OF THE INVENTION

An object of this invention is to provide a simple, easy to use chord playing attachment for stringed instruments.

Another object of this invention is to provide a chord playing attachment which easily aligns with the desired strings of the instrument.

Briefly, the invention comprises a L shaped base having a shorter leg which abuts a first side portion of the musical instruments's neck, and a longer leg which overlies the strings of the instrument. A number of spacers, some of which extend between adjacent strings, engage the neck of the instrument to support the longer leg above the strings. A pair of straps attached to the shorter leg of the base wrap around the neck of the instrument and attach with cooperating fasteners (such as VELCRO TM) to the longer leg of the base.

A number of pushbutton assemblies are supported by the longer leg, where each pushbutton assembly has a distinctly colored pushbutton and three fingers coupled to the pushbutton which extend through the longer leg of the base to a position overlying three individual strings of the instrument. A budding musician can play a chord on the instrument by pressing a single pushbutton and strumming the strings.

The invention also includes sheet music having sequential patterns of colored indicia corresponding to particular musical chords. Typically, lyrics are provided with the colored indicia, and musical accompaniment for the lyrics is accomplished by pressing the colored coded pushbutton of the chord playing attachment which corresponds to the colored indicia above the lyrics of the sheet music.

An advantage of this invention is that it is extremely easy for a beginner to learn how to play some simple songs.

Another advantage of this invention is that it easily attaches and detaches from the musical instrument with perfect alignment to the strings.

These and other objects and advantages of the present invention will no doubt become apparent upon a reading of the following descriptions and a study of the several figures of the drawing.

DETAILED DESCRIPTION OF THE PREFERRED EMBODIMENT

Figure 1:
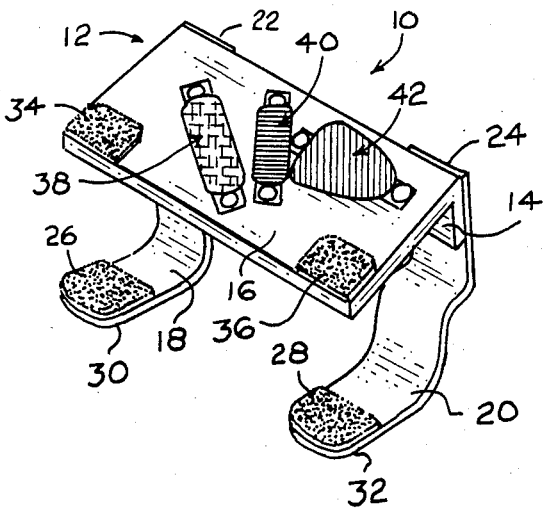
FIG. 1 is a perspective view of the present invention.

Referring to FIG. 1, a chord playing attachment 10 in accordance with the present invention includes a L shaped base 12 having a shorter leg 14 and a longer leg 16. A pair of straps 18 and 20 have first ends 22 and 24, respectively, attached to opposite ends of shorter leg 14, and are provided with cooperating strips 26 and 28 at their second ends 30 and 32, respectively. Cooperating strips 26/28 may engage mating cooperating strips 34 and 36 which are attached to longer leg 16. A number of pushbutton assemblies 38, 40, and 42 are supported by longer leg 16.

Figure 2:
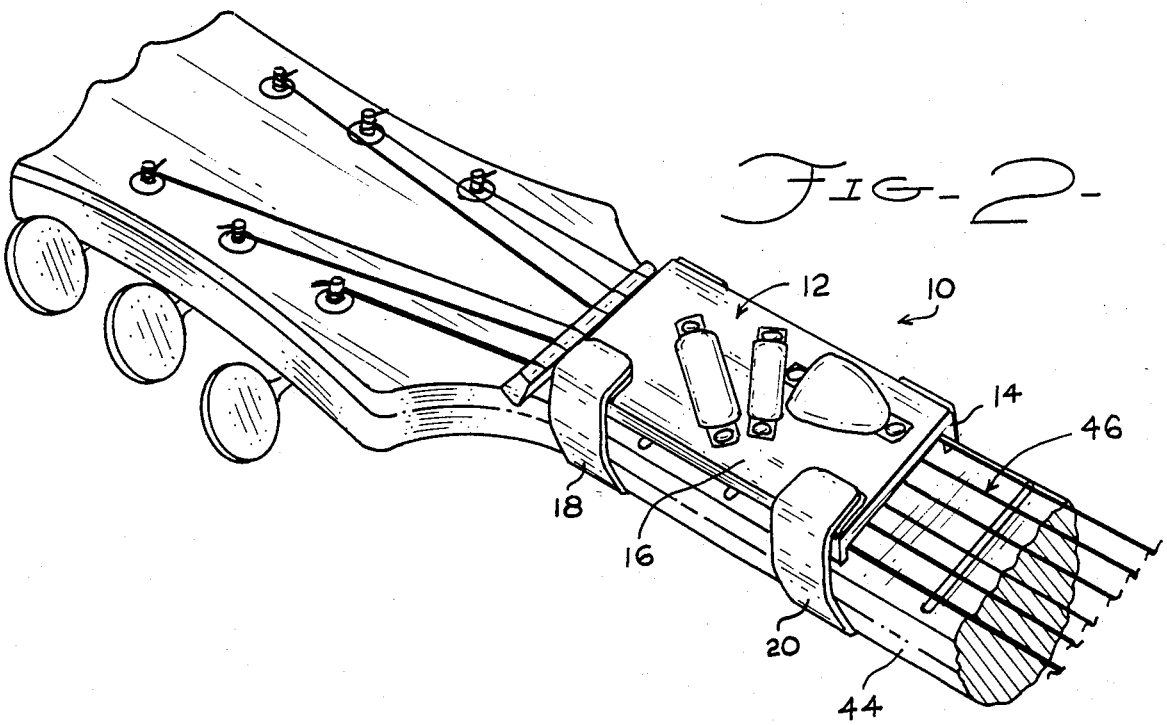
FIG. 2 is a perspective view of the present invention attached to the neck of a guitar.

Referring now to FIG. 2, chord playing attachment 10 is shown attached around the neck 44 and strings 46 of a guitar. Straps 18 and 20 encircle neck 44 to engage leg 14 with the side of neck 44, and position longer leg 16 over strings 46.

Figure 3:
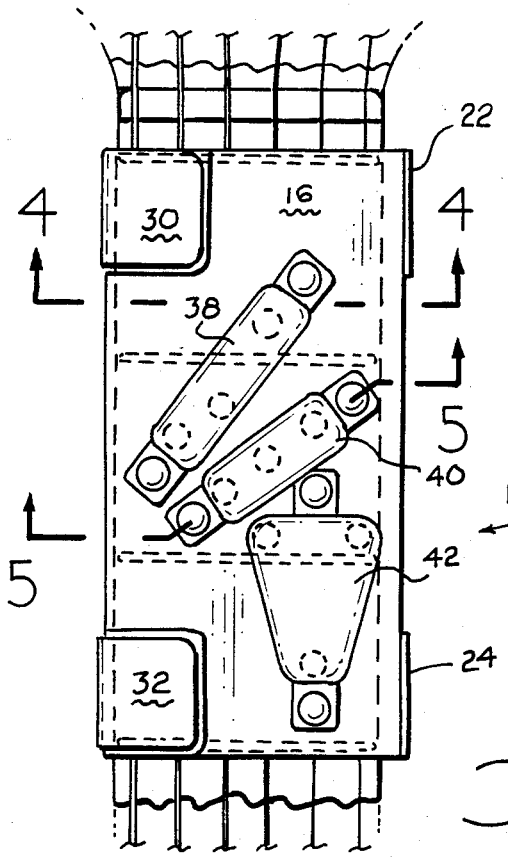
FIG. 3 is a top plan view of FIG. 2.
Figure 4:
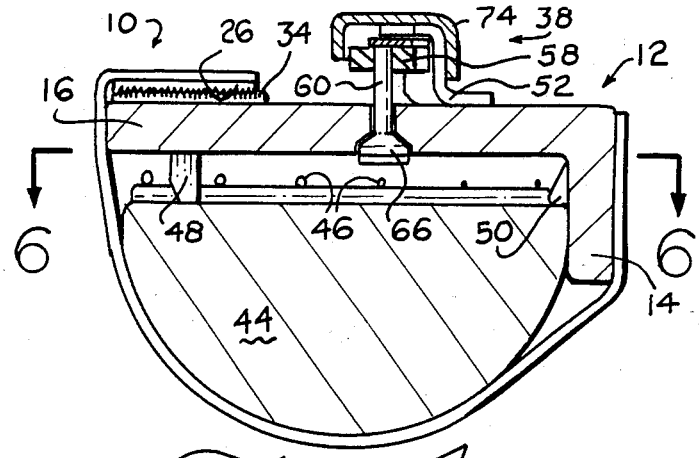
FIG. 4 is a cross sectional view taken along line 4—4 of FIG. 3.
Figure 5:
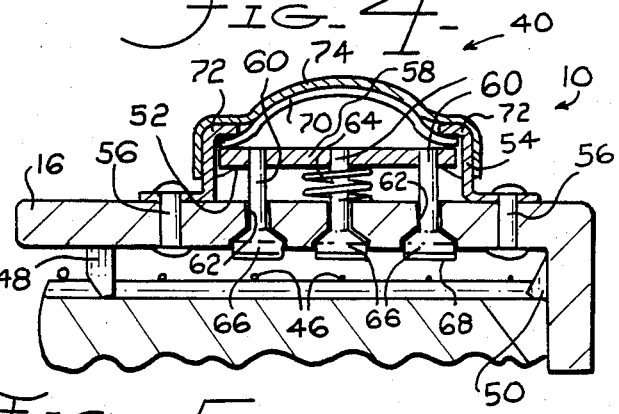
FIG. 5 is a cross sectional view taken along line 5—5 of FIG. 3.

Referring now to FIGS. 3–5, L shaped base 12 is provided with a plurality of spacers 48 and 50 which holds the longer leg 16 above strings 46. Spacers 48 extend through a pair of strings 46 to contact the upper surface of neck 44. Spacers 50, in cooperation with shorter leg 14, engage side portions of the neck, accurately aligning attachment 10 in its lateral sense with strings 46.

Figure 6:
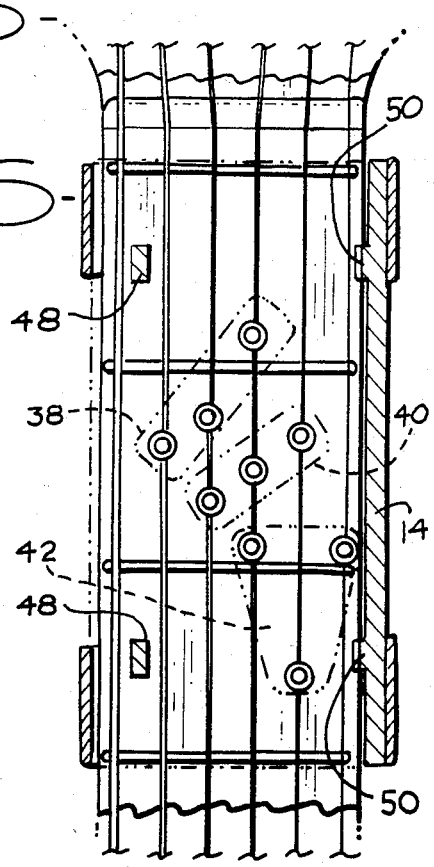
FIG. 6 is a cross sectional view taken along line 6—6 of FIG. 4.

Referring more particularly to FIGS. 5–6, the construction of each of pushbutton assemblies 38–42 are substantially the same, although their configurations may vary somewhat to accommodate different chords. Each pushbutton assembly includes a separated pair of guide members 52 and 54 attached to longer leg 16 by suitable means such as rivets 56, a support plate 58 guided by guide members 52/54, and three fingers 60 attached to support plate 58 and extending through apertures 62 in leg 16 of base 12. A compression spring 64 is disposed around one of fingers 60 to bias support plate 58 away from leg 16 of base 12.

Each of fingers 60 widen into pads 66 at their lower extremity to contact and depress strings 46. Pad 66 may be provided with a non-slip surface 68 of rubber or felt to aid in the engagement between fingers 66 and strings 46.

An arcuate leaf spring 70 has its feet engaged with stop portions 72 of guide members 52/54, and provides a snap-action for the pushbutton assembly. Spring 70 allows the pushbutton assemblies to be held in their depressed position with minimal effort due to a leveraging force of its end portions against guide members 52/54 which opposes the biasing force of spring 64. This is an important feature for children and other people who do not have great finger strength. The entire pushbutton assembly is covered with a flexible, colored covering 74 which, as will be discussed subsequently, correspond to colored indicia on sheet music forming a part of this invention.

Figure 7:
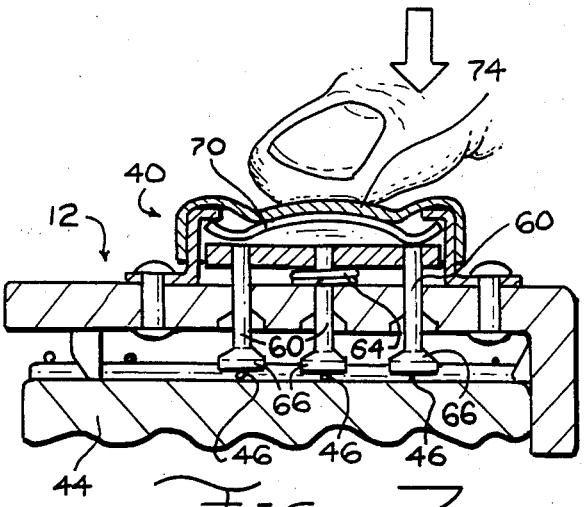
FIG. 7 is an operational view similar to the cross section of FIG. 5.

The operation of the the present invention will be discussed with reference to FIGS. 6 and 7. In FIG. 7, a finger F is shown pressing pushbutton assembly 40 to cause pads 66 to push three strings 46 against neck 44. After the pressure of finger F is removed from pushbutton assembly 40 it will return, under the biasing force of spring 64, to the position shown in FIG. 5. Leaf spring 70 provides a snap action to pushbutton 40, and serves as a support for covering 74.

As best seen in FIG. 6, pushbutton assembly 38 presses the strings required for a E chord, pushbutton assembly 40 depresses the strings for an A chord, and pushbutton assembly 42 depressed the strings for a D chord. These three common chords form the basis for hundreds of popular songs.

Figure 8:
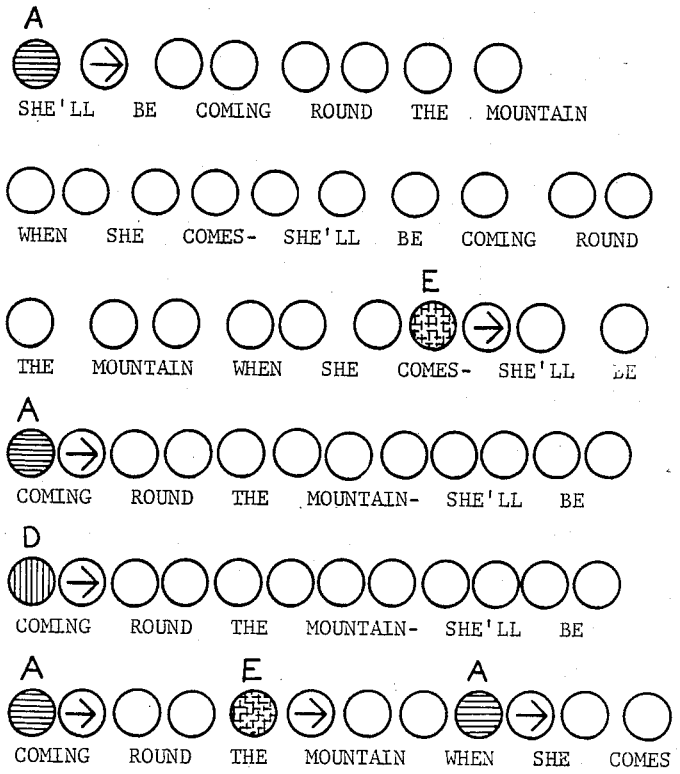
FIG. 8 illustrates a portion of the present invention including sheet music and accompanying color-coded chord representations.

Referring now to FIG. 8, the invention further includes sheet music 76 provided with lyrics 78 and a sequential pattern of colored indicia 80. The colored indicia are preferably in the form of colored circles 82, 84, and 86. Colored circle 82 (which indicates the E chord) is yellow, and corresponds to a yellow covering 74 on pushbutton 38. Colored circle 84 is blue (indicating an A chord), and corresponds to a blue covering on pushbutton 40. Colored circle 86 is red (indicating a D chord) and corresponds to a red covering on pushbutton 42.

In use, a player will sing the lyrics 78 and press the pushbutton assembly 38–42 which corresponds to the colored circles 82–86 associated with the particular lyric. Each circle represents a strum of the strings for that particular chord.

While this invention has been described in terms of a preferred embodiment, it is contemplated that persons reading the preceding description and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A chord playing attachment for musical instruments having a neck and a plurality of strings associated with said neck, said attachment comprising:

an L shaped base having a shorter leg adapted to abut a first side portion of said neck and a longer leg adapted to overlie said plurality of strings and said neck, said base being provided with spacer means to space said longer leg from said neck and said strings, said spacer means including at least one spacer attached to a lower surface of said longer leg of said base which extends between an adjacent pair of said strings to contact said neck;

strap means having one end attached to said shorter leg, said strap means being adapted to encircle said neck such that said second end may attach to said longer leg, said strap means including a pair of straps, each having a first end attached to said shorter leg and each having a first cooperating member attached to a second end for engagement with a second cooperating member attached to said longer leg;

a plurality of pushbutton assemblies supported by said longer leg, each pushbutton assembly having a distinctly colored pushbutton and three fingers coupled to said pushbutton and extending through said longer leg of said base to a position overlying three individual strings, said pushbutton being biased away from said longer leg such that pressing said pushbutton causes said fingers to press said strings against said neck and releasing said pushbutton allows said fingers to disengage from said strings, wherein each of said pushbutton assemblies includes a pair of spaced apart guide members attached to said longer leg and provided with stops proximate their upper ends, a support member vertically guided by said guide members, said fingers extending downwardly from said support member, and means biasing said support member towards said stops of said guide members, and wherein each of said pushbutton assemblies further includes an arcuate leaf spring abutting an upper surface of said support member, and a flexible, colored material covering said leaf spring; and sheet music including a sequential pattern of colored indicia corresponding to a particular musical chord, said colored indicia indicating which of said colored pushbuttons should be pushed for a particular musical composition, said sheet music further including lyrics associated with said colored indicia such that the proper chords for words within said lyrics are indicated by said colored indicia.

* * * * *